US006971588B1

(12) United States Patent
Tarr et al.

(10) Patent No.: US 6,971,588 B1
(45) Date of Patent: Dec. 6, 2005

(54) POP-UP CLEANING HEAD FOR SWIMMING POOL AND METHOD

(75) Inventors: William C. Tarr, Waddell, AZ (US); Andy F. Blake, Phoenix, AZ (US); Paul A. Womack, Glendale, AZ (US)

(73) Assignee: Shasta Industries, Inc., Phoenix, AZ (US)

( * ) Notice: Subject to any disclaimer, the term of this patent is extended or adjusted under 35 U.S.C. 154(b) by 66 days.

(21) Appl. No.: 10/360,444

(22) Filed: Feb. 7, 2003

(51) Int. Cl.[7] ..... B05B 15/10

(52) U.S. Cl. ..... 239/204; 239/205; 239/206; 4/490

(58) Field of Search ..... 239/66, 204, 205, 239/206; 4/490; 134/167 R

(56) References Cited

U.S. PATENT DOCUMENTS

| | | | | |
|---|---|---|---|---|
| 4,322,860 A | | 4/1982 | Gould | 4/490 |
| 4,347,979 A | * | 9/1982 | Mathews | 239/206 |
| 4,371,994 A | * | 2/1983 | Mathews | 4/490 |
| 4,391,005 A | * | 7/1983 | Goettl | 4/490 |
| 4,570,663 A | | 2/1986 | Gould et al. | 137/119 |
| 4,817,656 A | | 4/1989 | Gould | 137/2 |
| 5,058,806 A | * | 10/1991 | Rupar | 239/205 |
| 5,251,343 A | * | 10/1993 | Goettl | 4/490 |
| 5,365,617 A | | 11/1994 | Tarr | 4/508 |
| 6,022,481 A | | 2/2000 | Blake | 210/776 |
| 6,301,723 B1 | * | 10/2001 | Goettl | 4/490 |
| 6,393,629 B1 | * | 5/2002 | Barnes et al. | 4/490 |

* cited by examiner

*Primary Examiner*—David A. Scherbel
*Assistant Examiner*—Thach H. Bui
(74) *Attorney, Agent, or Firm*—Cahill, von Hellens & Glazer P.L.C.

(57) ABSTRACT

A cleaning head for installation in a swimming pool floor fitting (9) includes a pop-up cylinder (5) having a plurality of first camming elements (44) disposed on its outer wall, a compression spring (6) disposed around it, and an outer cylinder (11) having a plurality of second camming elements (42) and third camming elements (40) disposed along the inner wall (47A) of the outer cylinder (11) for engagement with the first camming elements. A nozzle cap (15) is removably attached to the upper end of the pop-up cylinder (5), and includes a plurality of nozzles having various diameters, respectively, only a selected one of the nozzles being aligned with a clearance opening (20) of the pop-up cylinder.

2 Claims, 5 Drawing Sheets

POP-UP CLEANING HEAD FOR SWIMMING POOL AND METHOD

BACKGROUND OF THE INVENTION

The present invention relates generally to pop-up cleaning heads for use in automatic swimming pool cleaning systems to eject jets of water in successive angular directions about a central point along the bottom of a swimming pool as water pressure applied to the cleaning head is intermittently cycled on and off.

More particularly, the present invention relates to improvements in pop-up cleaning heads which facilitate convenient disassembly and cleaning of the heads, improved fluid flow of pool water pumped through the cleaning heads, convenient modification of the nozzle aperture for the high velocity streams of cleaning water pumped through the cleaning heads, and convenient changing of the desired color of the cleaning heads and associated floor fittings to match the interior pool surface finish.

The closest prior art is thought to be commonly owned patent U.S. Pat. No. 4,322,860 (referred to as the '860 patent) by Henry D. Gould, issued Apr. 6, 1982, entitled "Pool Cleaning Head with Rotary Pop-up Jet Producing Element", incorporated herein by reference. The pop-up cleaning head assembly described in the '860 patent includes a hollow cylindrical lower section open at its bottom and an enlarged cylindrical hollow upper section closed at its top. An outlet opening is disposed in a vertical cylindrical wall of the upper section, and a stainless steel camming pin extends from the vertical cylindrical wall of the lower section to engage opposed, staggered upper and lower sawtooth-like camming surfaces disposed along an inner cylindrical wall of a stationary section of the cleaning head. The stationary section of the cleaning head engages a housing installed in the bottom surface of the swimming pool and is coupled to an intermittent or cyclical high-pressure water supply.

As the water pressure is cyclically applied (by means of a conventional multi-port distribution valve), the pop-up jet-producing element of the cleaning head pops up against the force of a compression spring in response to applied water pressure. The pop-up jet-producing element of the cleaning head then is retracted by the force of the compression spring when the water pressure is no longer applied. The camming pin engages upper and lower edges of the saw-tooth-like camming elements which are located along the inner surface of the outer cylinder. This causes an operation wherein the rotary pop-up element pops up and rotates a predetermined amount each time the water pressure is turned on, and is retracted each time the water pressure is turned off. The structure of the pop-up cleaning head is rather complex, and requires use of drills and pins for initial assembly. The pop-up cleaning head includes a vertical, axial shaft or center pin that supports the camming pin. The camming pin must be removed using an appropriate tool in order to disassemble the pop-up cleaning head to allow maintenance or routine cleaning which may be necessary after an extended period of use. The vertical shaft is supported by transverse members that are located in the path of flow of the pool water.

Most of the prior pop-up cleaning heads are not capable of convenient, easy disassembly for cleaning and maintenance and re-installation. However, a prior pop-up pool cleaning head made in Spain has a cap section that is removably attached to a hollow pop-up jet-producing cylinder that pops up and down similarly to the above-mentioned hollow cylinder sections of patent U.S. Pat. No. 4,322,860. The cap section can be easily removed to allow cleaning or other maintenance of the cleaning head. The cleaning head does not use a compression spring as described in patent U.S. Pat. No. 4,322,860, and instead uses a heavy weight installed in the bottom of the hollow cylinder. The downward force of the weight retracts the pop-up jet-producing hollow cylinder when water pressure is no longer applied. Because of its gravity-based operation, this cleaning head must be installed in a generally vertical orientation in order to operate properly, and cannot be used to clean a steeply sloped or vertical pool surface.

A problem with all known prior art pop-up cleaning heads is that if a different diameter nozzle opening is required to increase or decrease the diameter of the cleaning jet in order to "fine tune" the pool cleaning system, the entire pop-up cleaning head assembly must be replaced with one having the desired aperture diameter.

Another problem in use of the prior pop-up cleaning head assemblies and floor fittings has been that swimming pool customers often initially choose one interior pool finish, such as white plaster, and later change their minds and request a different type and color of interior pool finish after the floor fittings have already been installed in the concrete forming the swimming pool floor. When that happens, it is necessary to ream or jack-hammer out the installed floor fittings and reinstall new ones that match the color of the newly selected interior pool surface finish. This is an undesirably time-consuming, costly procedure.

Thus, there is an unmet need for an improved pop-up cleaning head that avoids the need to utilize tools to disassemble/reassemble a pop-up cleaning head for the purpose of cleaning it after extended use and can be used to clean a horizontal or steeply sloped or vertical pool surface.

There also is an unmet need for a pop-up cleaning head which allows fast, convenient "fine tuning" of the cleaning characteristics of an automatic swimming pool cleaning system, and also a need to avoid the need to replace a pop-up cleaning head in a swimming pool in order to obtain a cleaning jet of a different diameter.

There also is an unmet need for an improved pop-up cleaning head which allows for improved flow of water compared to the closest prior art pop-up cleaning heads.

There also is an unmet need for an improved pop-up cleaning head which can be assembled or disassembled without use of pins or tools and can be used to clean a horizontal or steeply sloped or vertical pool surface.

There also is an unmet need for a pop-up cleaning head and floor fitting assembly which avoids the need to ream or jack-hammer out already-installed floor fittings and reinstall new ones that match the color of a interior pool surface finish which has been selected after the original floor fittings were installed.

SUMMARY OF THE INVENTION

Accordingly, it is an object of the present invention to provide a pop-up cleaning head which can be easily removed from a swimming pool, easily disassembled and cleaned, and easily re-installed in the swimming pool and can be used to clean a horizontal or steeply sloped or vertical pool surface.

It is another object of the present invention to avoid the need to utilize tools to disassemble/reassemble a pop-up cleaning head which can be used to clean a horizontal or steeply sloped or vertical pool surface for the purpose of cleaning and/or repairing the head.

It is another object of the invention to provide a pop-up cleaning head which can be used to clean a horizontal or steeply sloped or vertical pool surface and which can be easily removed from the swimming pool and disassembled to allow easy field replacement of worn/broken components and easy reassembly and reinstallation of the cleaning head in the swimming pool.

It is another object of the invention to provide a pop-up cleaning head which allows fast, convenient "fine tuning" of the cleaning characteristics of an automatic swimming pool cleaning system.

It is another object of the invention to avoid the need to replace a pop-up cleaning head and a swimming pool in order to provide a cleaning jet having a different diameter.

It is another object of the invention to provide a pop-up cleaning head which is capable of producing a cleaning jet having any of a plurality of selectable diameters.

It is another object of the invention to provide an improved pop-up cleaning head which provides less resistance to flow of water than prior art pop-up cleaning heads.

It is another object of the invention to provide a pop-up cleaning head and associated floor fitting assembly which avoids the need to ream or jack-hammer out already-installed floor fittings and reinstall new ones that match the color of a interior pool surface finish which has been selected after the original floor fittings were installed.

It is another object of the invention to avoid the need to provide an inventory of complete pop-up cleaning head assemblies of a various colors.

Briefly described, and in accordance with one embodiment, the present invention provides a cleaning head for installation in a floor fitting (9) installed in the floor of a swimming pool. The floor fitting (9) has an upper surface generally flush with the surface of the interior pool finish material. The floor fitting receives pool water, the pressure of which is intermittently or periodically cycled between a relatively low value and a relatively high value, and includes a hollow pop-up cylinder (5) having a open lower end, an open upper end, a generally cylindrical outer wall, a clearance opening (20) extending through an upper portion of the outer wall, and a plurality of a camming elements (44) disposed on the outer wall. A lower spring retaining element (3) is attached to the lower end of the popup cylinder (5). A hollow outer cylinder (11) is adapted for removable installation in the floor fitting (9), and has a generally cylindrical outer wall (47) and a generally cylindrical inner wall (47A). A compression spring (6) is disposed around the lower portion of the pop-up cylinder (5) between the lower spring retaining element (3) and an upper spring retaining element (7) that engages the outer cylinder (11). A plurality of camming elements are disposed along the inner wall (47A) of the outer cylinder (11). In the described embodiment, the plurality of camming elements includes a first row of upper camming elements (42) disposed along the inner wall (47A) of the outer cylinder (11), a second row of lower camming elements (40) disposed along the inner wall (47A) of outer cylinder (11). A locking element is disposed on the outer wall (47) of the outer cylinder (11) for locking engagement with an inner surface of the floor fitting (9). In the described embodiment, a nozzle unit (15) is removably attached to the upper end of the popup cylinder (5), and includes a plurality of nozzle openings having various diameters, respectively, only one of the nozzle openings being aligned with the cleaning jet opening (20).

In the described embodiment, each of the upper camming elements (42) on the inner wall (47A) of the outer cylinder (11) has a sloped downwardly facing camming surface, and each of the lower camming elements (40) on the inner wall (47A) of the outer cylinder (11) has a sloped upwardly facing camming surface. Each of the camming elements (44) on the outer wall of the pop-up cylinder (5) includes a sloped upwardly facing camming surface for engaging the sloped downwardly facing camming surface of an upper camming element (42) and a sloped downwardly facing camming surface for engaging the sloped upwardly facing camming surface of a lower camming element (40).

The nozzle unit (15) includes a locking mechanism (26B, C) for allowing the nozzle unit (15) to be removed from the upper end of the pop-up cylinder (5), rotated to align any selected nozzle opening with the clearance opening (20), and reattached to the upper end of the pop-up cylinder (5) in order to change the diameter of the cleaning jet ejected from the nozzle unit (15). A circumferential lip (9E) is provided within the upper end of the floor fitting(9). A removable snap on color ring (17) has a flange engaging the circumferential lip (9E) to effectuate snapping of the color ring onto the upper end of the floor fitting (9) to match the desired color of the interior pool finish.

DETAILED DESCRIPTION OF THE PREFERRED EMBODIMENTS

Figure 1:
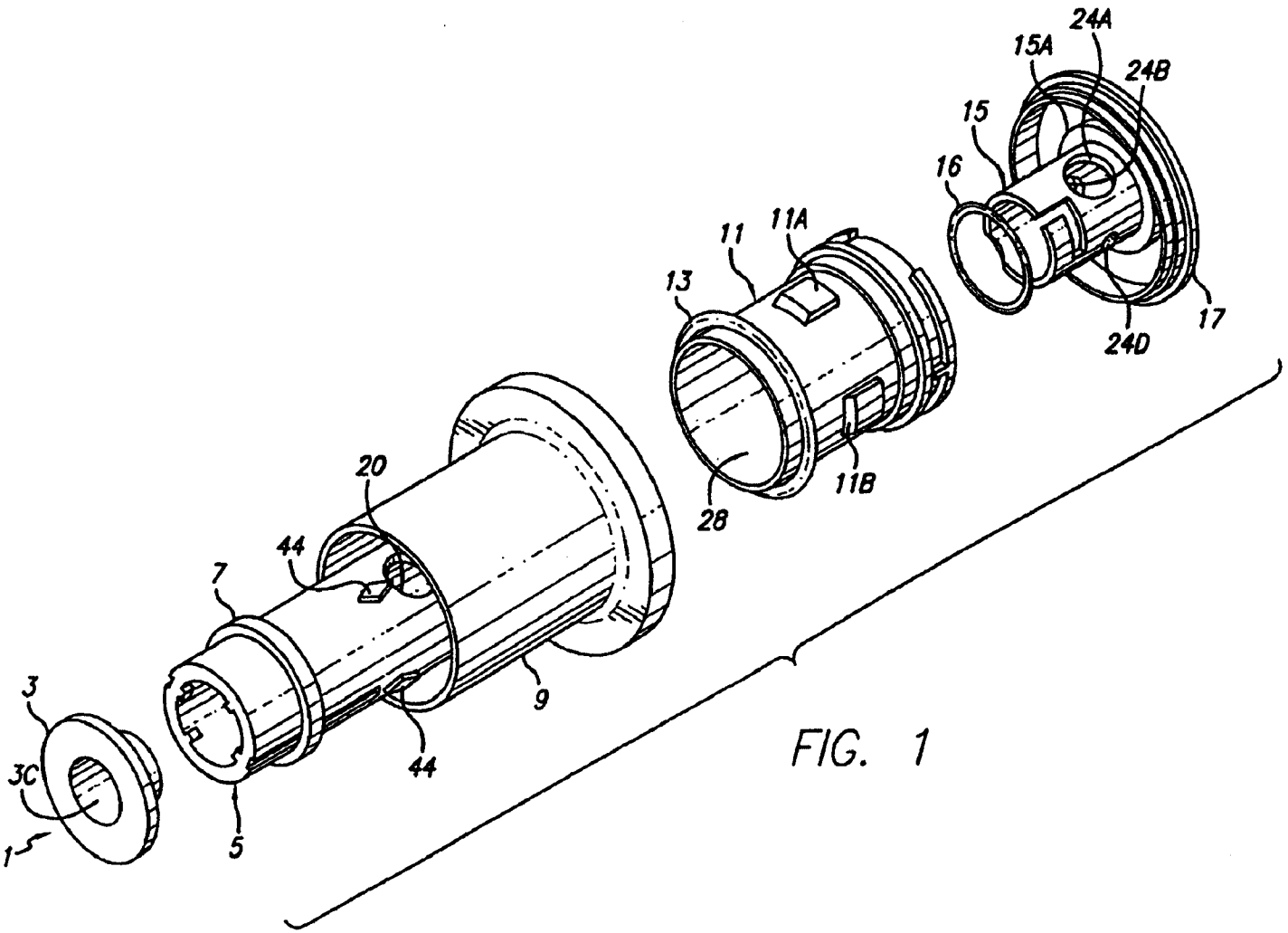
FIG. 1 is an exploded perspective view of a pop-up cleaning head.

Referring to the drawings, especially the exploded view shown in FIG. 1 pop-up cleaning head and floor fitting assembly 1 includes a pop-up cleaning head and a cylindrical floor fitting 9. The pop-up cleaning head includes a spring cap 3, a hollow rotary pop-up cylinder 5, a compression spring 6 disposed around the outer surface of pop-up cylinder 5, a spring retaining washer 7 disposed around pop-up cylinder 5, a hollow outer cylinder 11, a rotary nozzle 15, and a color ring 17.

Figure 2A:
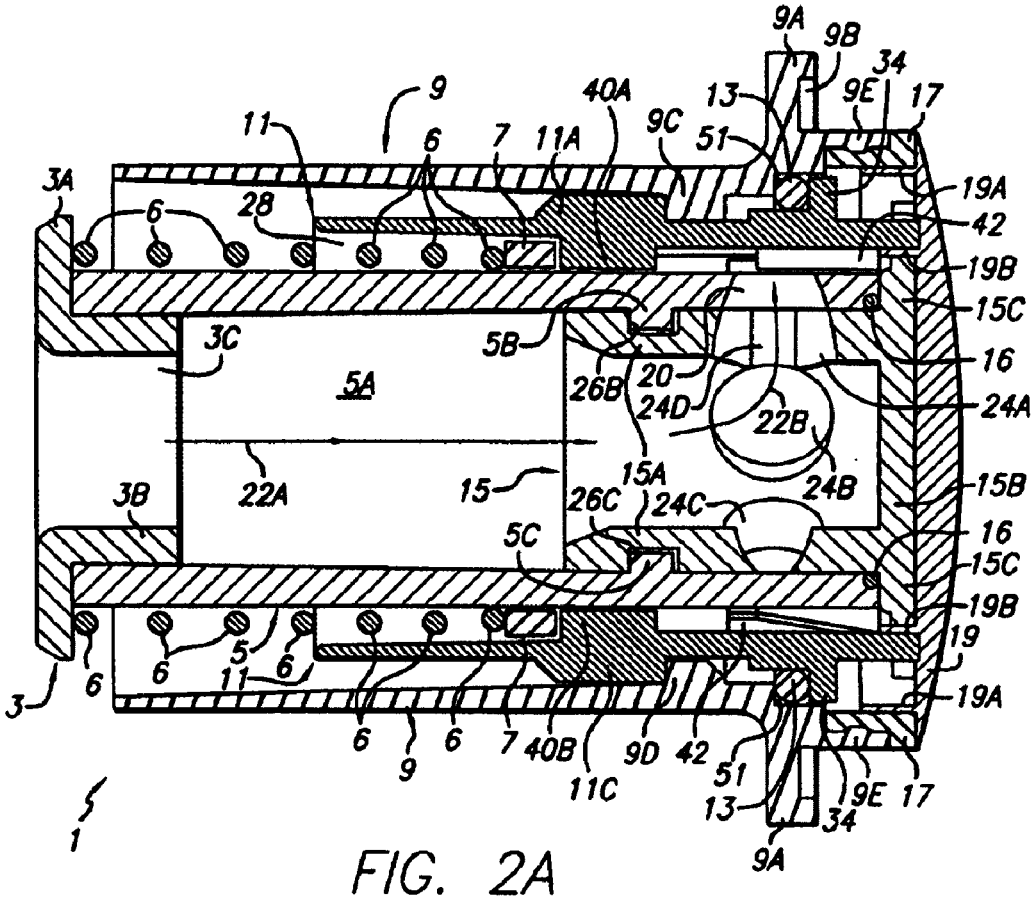
FIG. 2A is a section view of the pop-up cleaning head shown in FIG. 1, assembled with the nozzle assembly retracted.
Figure 2B:
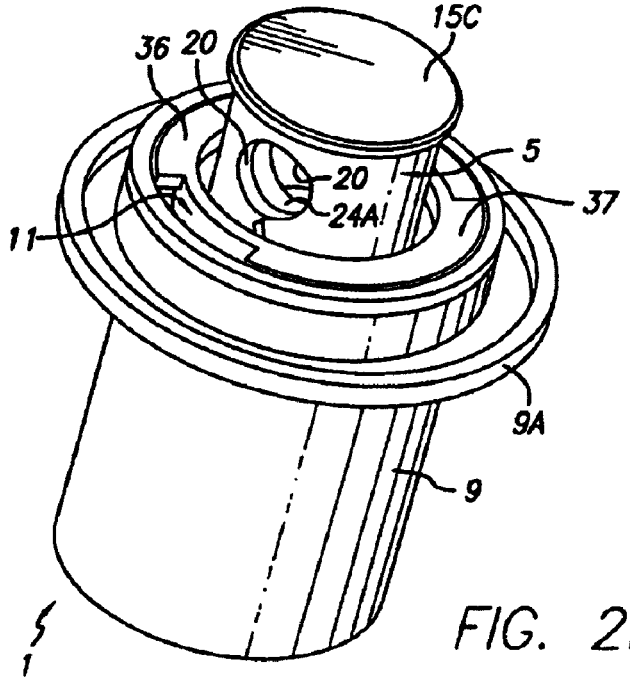
FIG. 2B is a section view of the assembled pop-up cleaning head shown in FIG. 2A with the nozzle assembly extended for cleaning operation.
Figure 3:
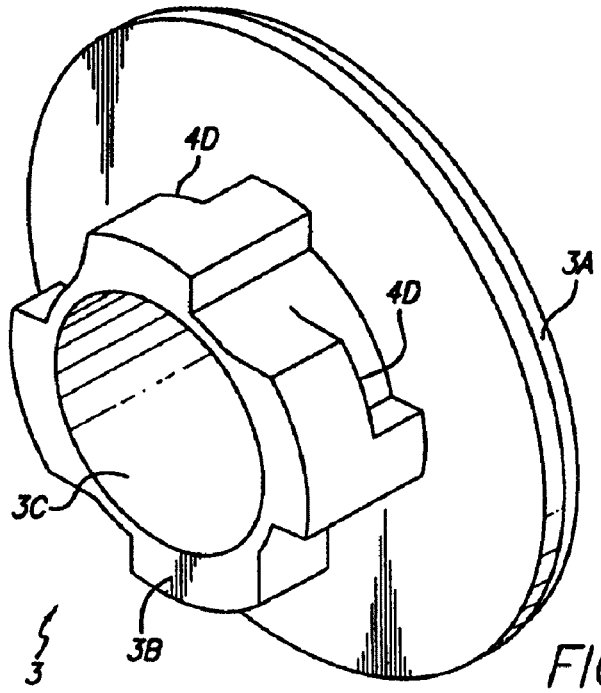
FIG. 3 is a perspective view of an inner portion of the lower spring cap 3 shown in FIG. 1.

A portion 3B (FIG. 3) of spring cap 3 extends into and is rotated to lock into the lower end of pop-up cylinder 5 as subsequently explained. A circular clearance opening 20 through which a cleaning jet of pool water can be ejected from a nozzle opening of nozzle 15 is disposed in the upper portion of the cylindrical wall of pop-up cylinder 5. Pop-up cylinder 5 extends into and engages outer cylinder 11, as subsequent explained, so as to cause pop-up cylinder 5 to partially "pop-up" out of outer cylinder 11 as shown in FIG. 2B and simultaneously rotate by an incremental amount each time water pressure applied through the central opening in spring cap 3 is cycled on and off. Outer cylinder 11 is inserted into and is rotated to lock into the upper inner portion of floor fitting 9. In the described embodiment, an end of a piece of 2 inch PVC pipe (not shown) extends through the pool floor concrete into and is cemented to the lower end of floor fitting 9. The intermittent or cyclically pressurized pool water is applied to pop-up cleaning head 1 through the PVC pipe.

Figure 6:
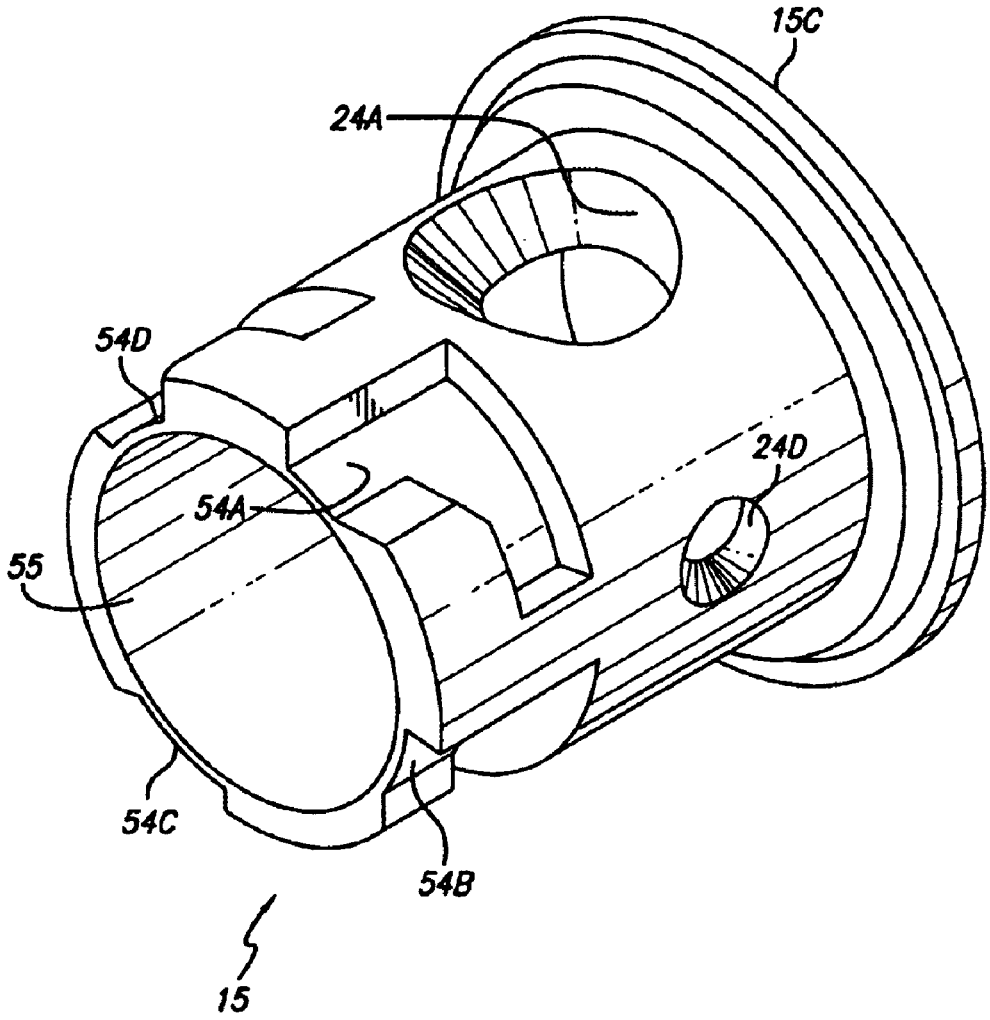
FIG. 6 is a perspective view of the nozzle assembly included in FIG. 1, showing two of four nozzle openings which all have different diameters.

Rotary nozzle cap 15, the details of which are shown in FIG. 6, extends into and engages the upper end of pop-up cylinder 5, as subsequently explained. Removable color ring 17 is snap-fit into the complete cleaning head assembly, as shown in FIG. 2A.

Figure 4:
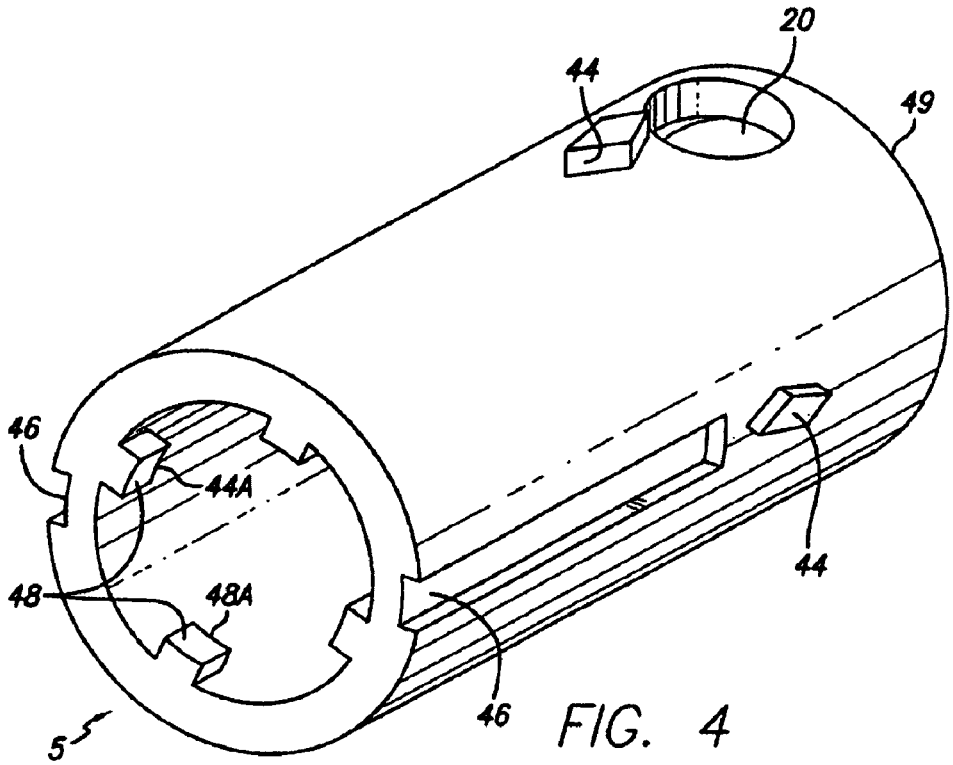
FIG. 4 is a bottom perspective view of the rotary pop-up cylinder 11 shown in FIG. 1.

Referring to FIGS. 1, 2A, 2B, 3, and 4, spring cap 3 includes a circular spring-retaining spring cap 3, a locking section 3B, and a central fluid opening 3C which extends concentrically through plate 3A and locking section 3B. Locking section 3B includes four L-shaped steps that engage the inner edges 47A of four corresponding bosses 48 disposed along the bottom inner wall of pop-up cylinder 5, as shown in FIG. 4, so that when locking section 3B is inserted into the lower end of pop-up cylinder 5 and spring cap 3 then is rotated, bosses 48 securely engage and lock spring cap 3 to the bottom of pop-up cylinder 5 spring cap 3. The periphery of plate 3A of spring cap 3 retains the left end of compression spring 6. The right end of compression spring 6 is retained by washer 7, which "rides" against and is retained in fixed relation to outer cylinder 11 by the lower edges of camming teeth 40, subsequently described with reference to FIG. 5B.

Referring to FIG. 4, pop-up cylinder 5 includes two diametrically opposed longitudinal grooves 46 that extend from the bottom end of pop-up cylinder 5 approximately two-thirds of the axial length of pop-up cylinder 5. Washer 7 has a pair of opposed inner tabs that extend into grooves 46, respectively, to prevent washer 7 from rotating relative to pop-up cylinder 5. Four equally spaced parallelogram-shaped or diamond-shaped camming elements 44 are attached on the outer surface of pop-up cylinder 5, two of them being axially aligned with grooves 46.

Figure 5A:
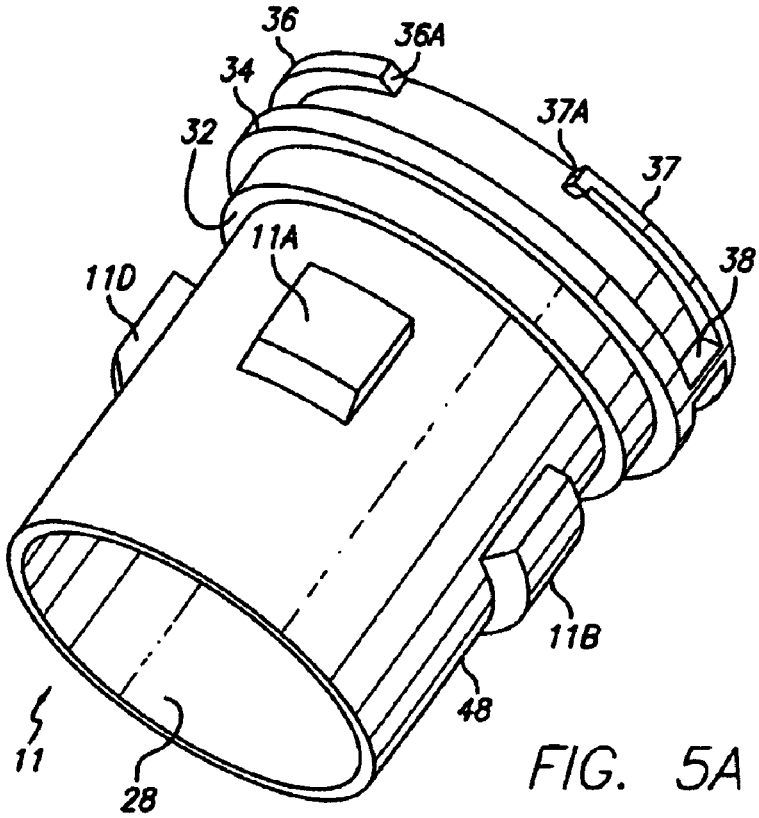
FIG. 5A is a bottom perspective view of the outer cylinder 11 shown in FIG. 1.
Figure 5B:
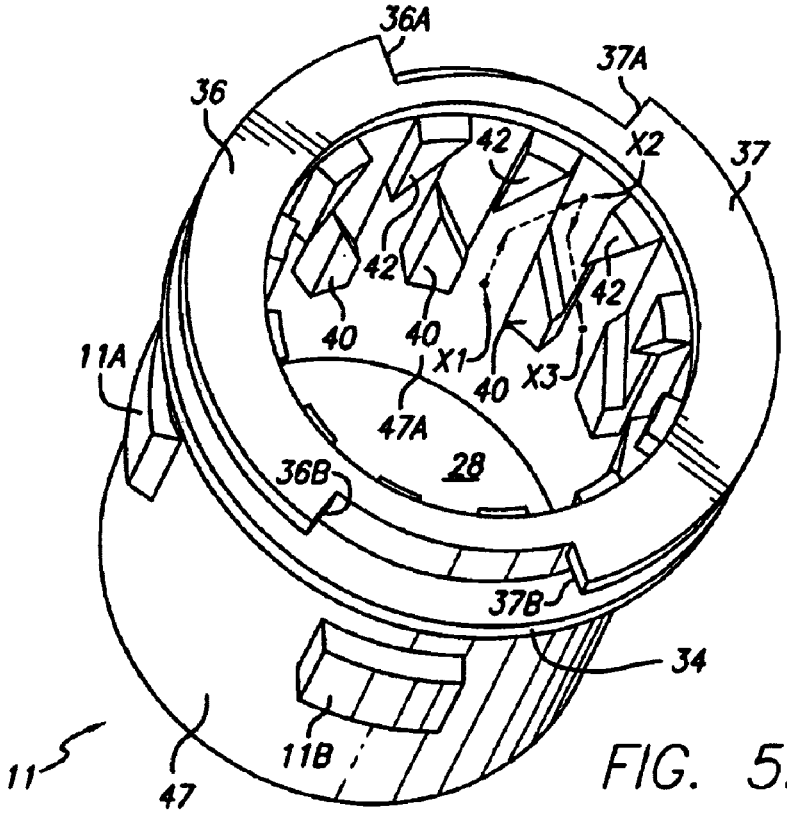
FIG. 5B is a top perspective view of the outer cylinder 11 shown in FIG. 5A.

The 4 camming elements 44 co-act with camming teeth 40 and 42 shown in FIG. 5B to cause incremental rotation of pop-up cylinder 5 to advance the angular direction of the cleaning jet ejected through clearance opening 20 of pop-up cylinder 5 and the selected one of nozzle openings 24A–D of nozzle cap 15 in response to the above-mentioned cyclical pool water pressure applied through the central opening 3C of spring cap 3.

The upper end 49 of pop-up cylinder 5 is inserted into the opening 28 at the lower end of outer cylinder 11. Retaining washer 7 engages the right end of compression spring 6 and consequently is pressed by spring 6 against the lower edges of the 4 parallelogram-shaped camming elements 44. As pop-up cylinder 5 is advanced further into outer cylinder 11 into the "popped up" configuration shown in FIG. 2B, the parallelogram-shaped camming elements 44 each advance between a corresponding pair of the lower camming teeth 40 and eventually engage the lower sloped surfaces of corresponding upper camming teeth 42, causing pop-up cylinder 5 to incrementally rotate clockwise by an amount equal to the width of an upper camming tooth 42. If pop-up cylinder 5 is retracted, each diamond-shaped camming element 44 engages a corresponding upper sloped surface of a corresponding camming tooth 40, which causes pop-up cylinder 5 to incrementally rotate further clockwise by an amount equal to the width of the lower camming tooth 40.

Referring to FIG. 5A, a pair of diametrically opposed semi-circular flanges 36 and 37 are connected to the top of cylindrical wall 47 of outer cylinder 11. A cutout region is defined between edges 36A and edges 37A of flanges 36 and 37, respectively, and a similar diametrically opposed cutout region is defined between edges 36B and 37B of semicircular flanges 36 and 37, respectively. The purpose of these two cutout regions is to receive a head removal tool. An annular flange 34 circumscribes the outer surface of wall 47 slightly below upper end flanges 36 and 37, and performs the function of retaining O ring 13 between the lower surface of annular flange 34 and an annular step 51 in the inner wall of floor fitting 9, as shown in FIG. 2A. O ring 13 provides a seal between floor fitting 9 and outer cylinder 11, but could be omitted if sufficiently close tolerances were to be provided therebetween. The purposes of the vertical feature 38 are to function as a brace for flange 37 and also to facilitate molding procedures.

When the upper edge 49 of pop-up cylinder 5 has been advanced far enough through outer cylinder 11 that upper edge 49 extends beyond the upper edges of upper camming teeth 42, then a lower locking section of nozzle cap 15 is inserted into the open upper end of pop-up cylinder 5 and rotated relative to pop-up cylinder 5 to cause 4 bosses such as 5B and 5C attached to the inner cylindrical wall of pop-up cylinder 5 to engage and retain edges such as 26B and 26C of corresponding locking tabs on the lower locking section of nozzle cap 15. An O ring 16 is retained between the lower surface of the annular peripheral portion 15C of the disk-shaped cover 15B of nozzle cap 15 and an inwardly sloped annular inner edge surface of the upper edge 49 (FIG. 4) of pop-up cylinder 5, in order to provide a water-tight seal between them.

Spring cap 3, pop-up cylinder 5, compression spring 6, outer cylinder 11, and nozzle cap 15 constitute a unitary cleaning head structure which can be easily installed in and removed from the floor fitting 9 in the bottom of the swimming pool. The assembly including spring cap 3, pop-up cylinder 5, compression spring 6, outer cylinder 11, and nozzle cap 15 is installed in floor fitting 9 by inserting it into the open upper end of floor fitting 9 and then rotating the assembly so that the locking tabs (such as 11A and 11B) equally spaced around the outer wall 47 of outer cylinder 11 engage and are locked to corresponding locking tabs (such as 9C and 9D) on the inside wall of floor fitting 9. Floor fitting 9 includes an annular flange 9A located approximately ⅜ inches below its upper edge to act as a water leakage stop, and also to securely anchor floor fitting 9 in the floor material of the swimming pool.

Spring cap 3, pop-up cylinder 5, outer cylinder 11, nozzle assembly 15, and floor fitting 9 preferably are composed of polyester material that does not deteriorate as a result of exposure to sunlight and also matches the desired color of the interior pool finish. Floor fitting 9 and nozzle cap 15 preferably also match the desired color of the interior pool finish.

Color ring 17 can be snapped-fit into the slot performed by the upper lip 9E of floor fitting 9.

In operation, it can be seen that if no water pressure is being applied to the interior of pop-up cylinder 5 through opening 3C of spring cap 3 and the above-mentioned supply pipe (not shown), then compression spring 6 forces pop-up cylinder 5 into its retracted position shown in FIG. 2A. This causes the diamond-shaped camming elements 44 on the outer surface of pop-up cylinder 5 to be located between various pairs of the lower camming teeth 40 on the interior wall of outer cylinder 11. For example, one of the diamond-shaped camming elements 44 would be located at the point X1 in FIG. 5B.

If a high water pressure then is applied through the supply pipe to the interior of pop-up cylinder 5, the resulting upward force causes the assembly including spring cap 3, pop-up cylinder 5, and nozzle cap 15 to move upward, compressing spring 6 and extending the upper part of the assembly above floor fitting 9, as shown in FIG. 2B, so that clearance opening 20 at the upper end pop-up cylinder 5 is located slightly above the surface of the swimming pool. Pressurized pool water then is ejected tangentially through the one of nozzle openings 24A–D that is aligned with clearance opening 20 of pop-up cylinder 5 along the swimming pool surface. The diameter and intensity of the ejected cleaning jet is determined by which of the four nozzle apertures 24A–D is aligned with opening 20. The advancing of pop-up cylinder 9 advances the above mentioned diamond-shaped camming element 44 to a position X2 in FIG. 5B, such that the sloped surfaces engage the sloped surfaces of upper teeth 42, causing the previously mentioned incremental rotation of pop-up cylinder 5 and the cleaning jet ejected through clearance opening 20.

When the water pressure is removed, compression spring 6 expands to cause the pop-up cylinder 5 and the diamond-shaped camming elements 44 to be retracted, for example to the position indicated by X3 in FIG. 5B, causing the previously mentioned further incremental rotation of pop-up cylinder 5 and its opening 20.

The size of the selected nozzle aperture of pop-up cleaning head 1 can be easily changed by aligning a different one of the four round nozzle apertures 24A–D of nozzle cap 15 with the clearance opening 20 of pop-up cylinder 5 without the need to replace the entire pop-up head assembly from floor fitting 9. To accomplish this, the pop-up assembly including pop-up cylinder 5 and nozzle cap 15 can be temporarily removed from floor fitting 9. Then, nozzle cap 15 can be rotated to unlock it from pop-up cylinder 5, rotated relative to pop-up cylinder 5 in order to effectuate alignment of a different one of the nozzle apertures 24A–D with clearance opening 20, and then re-inserted and locked into the upper end of pop-up cylinder 5. The four L-shaped locking slots 54A–54D in the lower, outer wall of nozzle cap 15 as shown in FIG. 6 can be aligned with bosses such as 5B and 5C in any of 4 positions, so as to allow insertion and locking of nozzle cap 15 into the upper end of pop-up cylinder 5. Then nozzle cap 15 can be rotated so that each of the four bosses such as 5B and 5C fits securely into the upper, right hand portion of one of the four L-shaped slots 54A–D, respectively, in order to securely lock nozzle cap 15 onto pop-up cylinder 5 with the selected nozzle aperture 24A, 24B, 24C or 24D precisely aligned with clearance opening 20 of pop-up cylinder 5.

Alternatively, various nozzle caps 15 each having only one nozzle aperture can be provided, with a variety of different nozzle aperture diameters, and the nozzle aperture diameter of any particular pop-up cleaning head can be changed by manually removing its present nozzle-cap 15 and replacing it with one having a different nozzle aperture diameter.

Thus, the invention provides a pop-up cleaning head which can be easily removed from a swimming pool, disassembled and cleaned, and re-installed in the swimming pool, with no need to utilize any tools to disassemble/reassemble a pop-up cleaning head for the purpose of cleaning it. The use of compression spring 6 to retract the pop-up cylinder 5 when water pressure is relieved allows the pop-up cleaning head to be used for cleaning horizontal or steeply-sloped pool surfaces. The described pop-up cleaning head also is capable of producing a cleaning jet having any of a plurality of selectable diameters, and therefore allows fast, convenient "fine tuning" of the cleaning characteristics of an automatic swimming pool cleaning system. The described pop-up cleaning head also causes less resistance to flow of water than the closest prior art pop-up cleaning heads, because the interior path through pop-up cylinder 5 is free of the various structures associated with the camming elements of the prior art. The described pop-up swimming pool cleaning head can be assembled without a gluing operation and without use of pins or tools.

The use of color ring 17 avoids the need for a parts supplier to provide an inventory of complete pop-up cleaning heads of various colors. Instead, only inventories of various colors of outer cylinder 11, nozzle cap 15, and color ring 17 need to be maintained.

While the invention has been described with reference to several particular embodiments thereof, those skilled in the art will be able to make various modifications to the described embodiments of the invention without departing from its true spirit and scope. It is intended that all elements or steps which are insubstantially different from those recited in the claims but perform substantially the same functions, respectively, in substantially the same way to achieve the same result as what is claimed are within the scope of the invention. For example, various other plastics than polyester can be used. The various locking elements disclosed for spring cap 3, nozzle cap 15, outer cylinder 11, and floor fitting 9 could be replaced by different locking elements. In some implementations, camming teeth 40 and 42 shown on the inside surface of outer cylinder 11 could instead be provided on the outside surface of pop-up cylinder 5 and the camming teeth 44 on outer surface of pop-up cylinder 5 could instead be provided on the inside surface of outer cylinder 11. A different arrangement for retaining spring 6 can be utilized. In some implementations, a suitably weighted pop-up assembly could be used instead of using compression spring 6, spring cap 3, and retaining washer 7. In some implementations, the spring cap 3 could be cemented to the bottom of pop-up cylinder 5 instead of using the disclosed locking elements. Also, if the entire assembly including outer cylinder 11, pop-up cylinder 5, spring cap 3, and nozzle cap 15 were to be disposable, both spring cap 3 and nozzle cap 15 could be cemented to pop-up cylinder 5. In some cases, color ring 17 could be glued into place rather than snapped into place. One or more of the nozzle apertures in nozzle cap 15 could be other than round in order to provide altered cleaning characteristics.

What is claimed is:

1. A cleaning head for installation in a floor fitting installed in the floor of a swimming pool, the cleaning head having an upper surface generally flush with an upper surface of the floor fitting, the floor fitting receiving pressurized pool water, the pressure of which is intermittently or periodically cycled between a relatively low value and a relatively high value, comprising:

(a) a hollow pop-up cylinder having an open lower end, an open upper end, a generally cylindrical outer wall, a clearance opening extending through an upper portion of the outer wall, and a plurality of camming elements disposed on the outer wall;

(b) a lower spring retaining element attached to the lower end of the pop-up cylinder;

(c) a hollow outer cylinder adapted for removable installation in the floor fitting and having a generally cylindrical outer wall and a generally cylindrical inner wall, a first row of upper camming elements disposed along the inner wall of the outer cylinder, a second row of lower camming elements disposed along the inner wall of the outer cylinder, and a locking element disposed on the outer wall of the outer cylinder for locking engagement with an inner surface of the floor fitting:

(d) a compression spring disposed around the lower portion of the pop-up cylinder between the lower spring retaining element and an upper spring retaining element engaging the inner wall of the outer cylinder;

(e) a nozzle unit attached to the upper end of the pop-up cylinder, the nozzle unit including a nozzle aligned with the clearance opening; and (f) the upper end of the floor fitting includes a circumferential lip, the floor fitting also including a color ring attached to the circumferential lip.

2. A cleaning head for installation in a floor fitting installed in the floor of a swimming pool, the cleaning head having an upper surface generally flush with an upper surface of the floor fitting, the floor fitting receiving pressurized pool water, the pressure of which is intermittently or periodically cycled between a relatively low value and a relatively high value, comprising:

(a) a hollow pop-up cylinder having an open lower end, an open upper end, a generally cylindrical outer wall, a clearance opening extending through an upper portion of the outer wall, and a plurality of camming elements disposed on the outer wall;

(b) a lower spring retaining element attached to the lower end of the pop-up cylinder;

(c) a hollow outer cylinder adapted for removable installation in the floor fitting and having a generally cylindrical outer wall and a generally cylindrical inner wall, a first row of upper camming elements disposed along the inner wall of the outer cylinder, a second row of lower camming elements disposed along the inner wall of the outer cylinder, and a locking element disposed on the outer wall of the outer cylinder for locking engagement with an inner surface of the floor fitting;

(d) a compression spring disposed around the lower portion of the pop-up cylinder between the lower spring retaining element and an upper spring retaining element engaging the inner wall of the outer cylinder;

(e) a nozzle unit attached to the upper end of the pop-up cylinder, the nozzle unit including a nozzle aligned with the clearance opening;

(f) the upper end of the floor fitting includes a circumferential lip the floor fitting also including a color ring attached to the circumferential lip; and (g) the color ring is a removable ring including a cylindrical flange which snap fits onto the circumferential lip of the floor fitting.

* * * * *